US006666114B1

(12) United States Patent
Lin

(10) Patent No.: US 6,666,114 B1
(45) Date of Patent: Dec. 23, 2003

(54) MAGNETIC CONNECTING TUBE FOR A SCREWDRIVER HEAD

(76) Inventor: Peng-Ho Lin, No. 10, Lane 13, Fuh Ping Rd., Taiping (TW), 411

( * ) Notice: Subject to any disclaimer, the term of this patent is extended or adjusted under 35 U.S.C. 154(b) by 0 days.

(21) Appl. No.: 10/351,140

(22) Filed: Jan. 27, 2003

(51) Int. Cl.[7] ..... B25B 23/00
(52) U.S. Cl. ..... 81/438; 81/451; 279/155; 279/904
(58) Field of Search ..... 81/438, 436, 451, 81/429; 279/155, 904, 905

(56) References Cited

U.S. PATENT DOCUMENTS

| | | | | | |
|---|---|---|---|---|---|
| 5,996,452 | A | * | 12/1999 | Chiang | 81/429 |
| RE36,797 | E | * | 8/2000 | Eggert et al. | 81/438 |
| 6,199,872 | B1 | * | 3/2001 | Hasan | 279/30 |
| 6,325,393 | B1 | * | 12/2001 | Chen et al. | 279/22 |
| 6,530,299 | B1 | * | 3/2003 | Liu | 81/451 |

* cited by examiner

*Primary Examiner*—Joseph J. Hail, III
*Assistant Examiner*—Hadi Shakeri
(74) *Attorney, Agent, or Firm*—Troxell Law Office PLLC.; Kuo-Hsiung Chiu

(57) ABSTRACT

The present invention relates to a magnetic connecting tube for a screwdriver head with a main body, a push element, a spring element, a fastening ring, a block member and an engaging element. The main body having an engaging hole at one end thereof for receiving a hexagonal head which is secured by the engaging element in position. The main body includes under the engaging hole a through hole in which two permanent magnets are so arranged that the repulsive poles face to each other. When the hexagonal head is inserted into the engaging hole, it presses against the upper permanent magnet. In order to drive out the hexagonal head by means of the effect of the push element and the engaging element, the repulsive force between the permanent magnets is utilized to repel the hexagonal head out of the engaging hole. Meanwhile, the upper permanent magnet has the magnetic force to attract the hexagonal head such that the hexagonal head can be firmly attached and can't fall out of the engaging hole.

3 Claims, 4 Drawing Sheets

MAGNETIC CONNECTING TUBE FOR A SCREWDRIVER HEAD

BACKGROUND OF THE INVENTION

1. Field of the Invention

The present invention relates to a new and improved magnetic connecting tube for a screwdriver head, and more particularly, to an apparatus in which the repulsive force between two permanent magnets is utilized to drive out the screwdriver head. Meanwhile, the permanent magnet adjacent to the screwdriver head has the magnetic force to attract the screwdriver head such that the hexagonal head can be firmly attached and can't fall out of an engaging hole.

2. Description of the Prior Art

The screwing tools have been used for a long history. Their versions and structures are different according to the manufacturing factories and use surroundings. A conventional magnetic connecting tube, as illustrated in FIG. 6, for receiving hexagonal screwdriver head includes a main body 10, a push element 11, a spring element 12, a fastening ring 13 and two engaging pearls 14. The main body 10 has an engaging hole 15 at one end thereof for receiving a screwdriver head 16 and a compression spring 17 at the other end thereof. When the screwdriver head 16 is inserted into the engaging hole 15, it presses against the compression spring 17 in compressed state. When the push element 11 is used to push the engaging balls 14 inwardly, the screwdriver head 16 will be driven out of the engaging hole 15 by means of the restoring force of the compression spring 17.

Though the above-mentioned conventional structure can reach the expected effect of driving out the screwdriver head 16, it also has the following application drawbacks:

1. The restoring force of the compression spring 17 has to meet certain requirements in order to smoothly drive out the screwdriver head 16. Therefore, the screwdriver head 16 easily springs out of the engaging hole 15. The user has to catch it with care. Otherwise, it is difficult for him to find the screwdriver head 16 again when he works in a disorderly small room or for highrise outdoor operation. Accordingly, the work must be seriously influenced.
2. The screwdriver head 16 has its own weight and structural strength. When it springs out or falls down to the ground and unfortunately hits persons around there, the consequence will be too terrible to imagine.

SUMMARY OF THE INVENTION

It is a primary object of the present invention to eliminate the above-mentioned drawbacks and to provide a connecting tube for a screwdriver head in which the repulsive force between two permanent magnets is utilized to drive out the screwdriver head. Meanwhile, the permanent magnet adjacent to the screwdriver head has the magnetic force to attract the screwdriver head such that the hexagonal head can be firmly attached and can't fall out of an engaging hole. Therefore, the safety of persons around the operation site can be ensured. Moreover, a longer service life of the present invention can be maintained for thoroughly fulfilling the requirements of industries.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
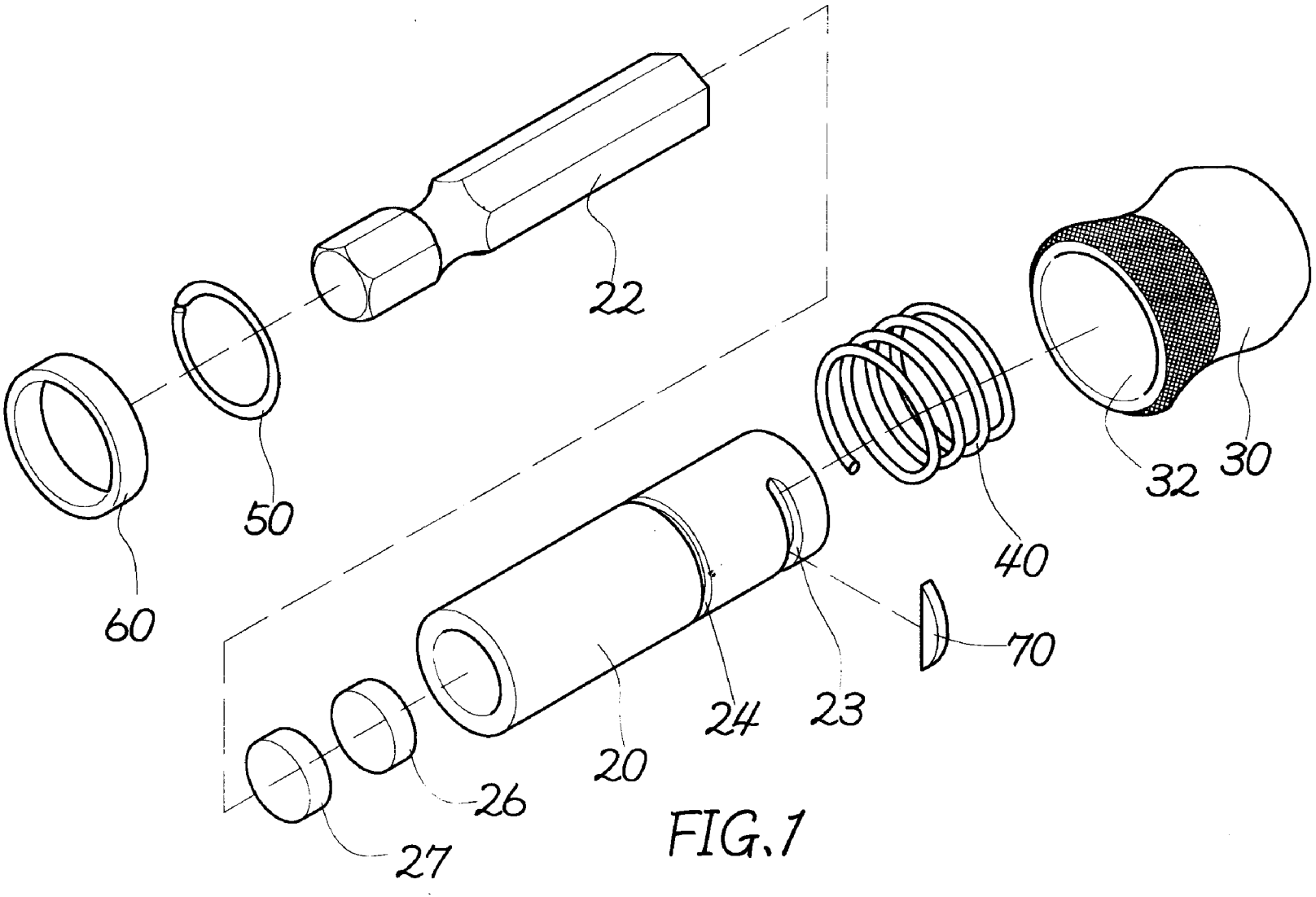
FIG. 1 is an exploded view of a preferred embodiment of the present invention.
Figure 3:
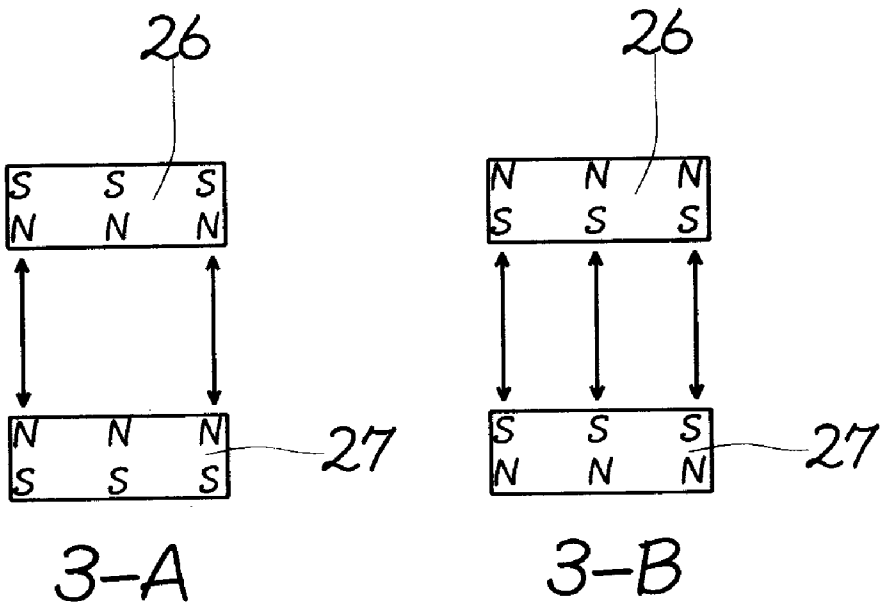
FIG. 3 is a schematic drawing of the arrangement of two permanent magnets of the present invention.
Figure 2:
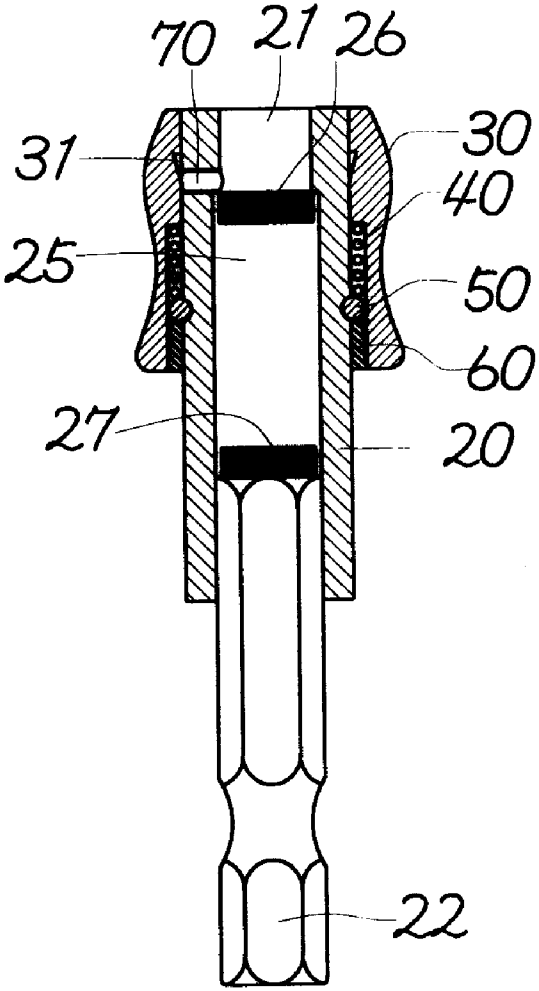
FIG. 2 is a sectional view of the preferred embodiment of FIG. 1.

First of all, referring to FIGS. 1, 2 and 3, a preferred embodiment of the present invention is shown. The magnetic connecting tube for a screwdriver head in accordance with the present invention includes a main body 20, a push element 30, a spring element 40, a fastening ring 50, a block member 60 and an engaging element 70. The main body 20 is a hollow tube having an engaging hole 21 at one end thereof for receiving a hexagonal head 80 and having another hole for receiving a hexagonal bar 22. The main body 20 includes a slot 23 near the engaging hole 21 for receiving the engaging element 70. The slot 23 communicates with the engaging hole 21. The main body 20 further includes an engaging groove 24 near the middle section thereof for receiving the fastening ring 50. The push element 30 is inserted on the outer side of the main body 20 and includes a tapered groove 31 at the inner wall thereof. The tapered groove 31 is located in alignment with the slot 23. An enlarged opening is formed at the rear end of the push element 30 for receiving the spring element 40. The block member 60 is inserted into the rear end of the push element 30 for preventing the push element 30 from separating from the main body 20.

The main body 20 includes under the engaging hole 21*a* through hole 25 in which two permanent magnets 26, 27 are so arranged that the repulsive poles face to each other (see FIG. 3).

Figure 5:
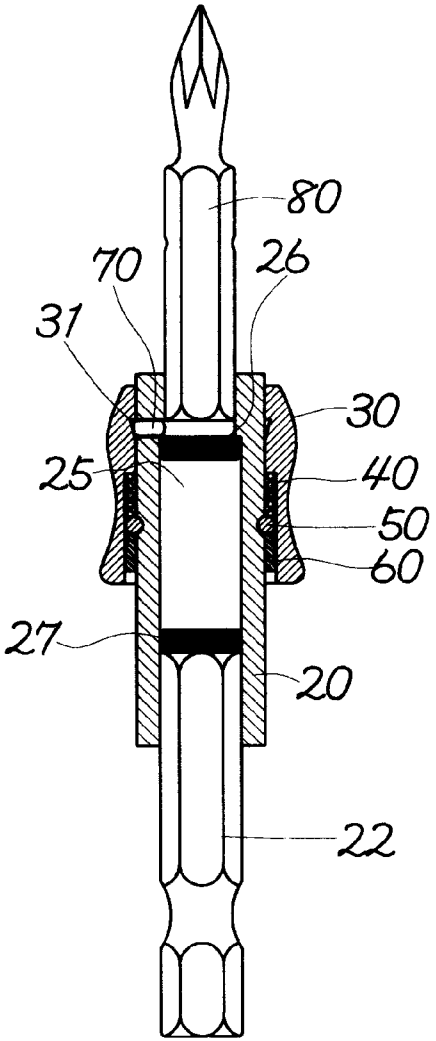
FIG. 5 is a schematic drawing of the present invention, showing that the screwdriver hexagonal head is driven out.
Figure 4:
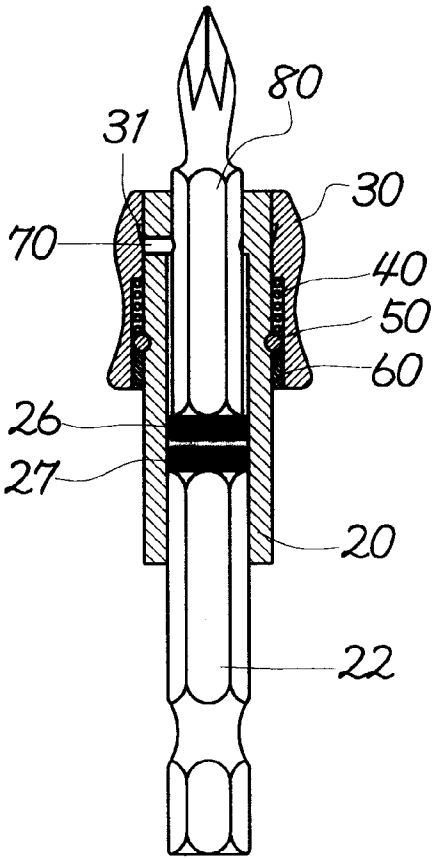
FIG. 4 is a schematic drawing of the present invention, showing that the screwdriver hexagonal head is inserted.
Figure 6:
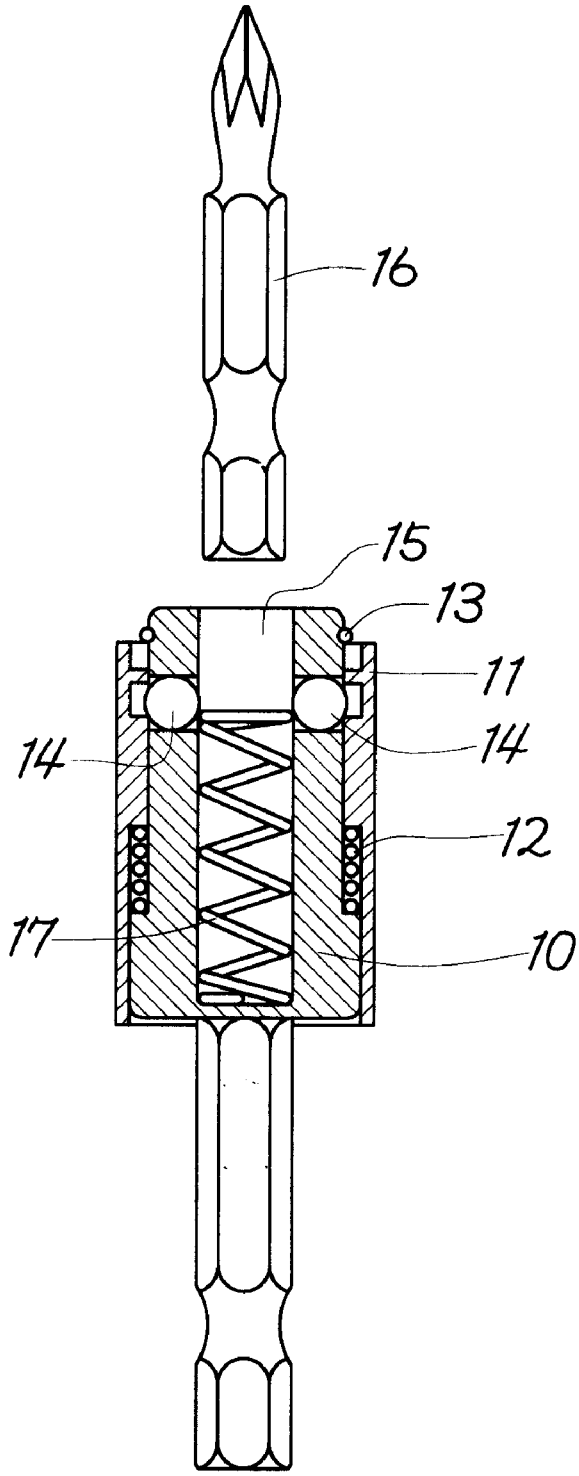
FIG.6 PRIOR ART
FIG. 6 is a sectional view of a prior art.

As shown in FIGS. 4 and 5, when the hexagonal head 80 is inserted into the engaging hole 21, it presses against the upper permanent magnet 26. In order to drive out the hexagonal head 80 by means of the effect of the push element 30 and the engaging element 70, the repulsive force between the permanent magnets 26, 27 is utilized to repel the hexagonal head 80 out of the engaging hole 21. Meanwhile, the upper permanent magnet 26 has the magnetic force to attract the hexagonal head 80 such that the hexagonal head 80 can be firmly attached and can't fall out of the engaging hole 21 (see FIG. 5).

Many changes and modifications in the above-described embodiment of the invention can, of course, be carried out without departing from the scope thereof. Accordingly, to promote the progress in science and the useful arts, the invention is disclosed and is intended to be limited only by the scope of the appended claim.

What is claimed is:

1. A magnetic connecting tube for a screwdriver head comprising:

a main body, a push element received around the main body, a spring element received in the push element, a fastening ring securing the push element to the main body, a block member inserted in the push element for preventing the push element form separating from the main body and an engaging element, the main body having an engaging hole having a first end thereof for receiving a hexagonal head which is releasably engaged by the engaging element, whereby the main body includes under the engaging hole a through hole in which two permanent magnets are so arranged so that the repulsive poles face towards each other thereby forcing the hexagonal head to exit the through hole while being maintained by one of the magnets within the engaging hole.

2. The magnetic connecting tube for a screwdriver head according to claim 1, wherein the push element has a tapered groove, the main body has a slot aligned with the tapered groove, and the engaging element is inserted in the slot between the tapered groove and the engaging hole.

3. The magnetic connecting tube for a screwdriver head according to claim 1, further comprising a hexagonal bar inserted into the through hole.

* * * * *